US011788257B2

(12) United States Patent
Wuisan et al.

(10) Patent No.: US 11,788,257 B2
(45) Date of Patent: Oct. 17, 2023

(54) WORK VEHICLE

(71) Applicant: DEERE & COMPANY, Moline, IL (US)

(72) Inventors: Giovanni A. Wuisan, Epworth, IA (US); Kurt A. Chipperfield, Dubuque, IA (US); Brian J. Gallagher, Cuba City, WI (US)

(73) Assignee: Deere & Company, Moline, IL (US)

( * ) Notice: Subject to any disclaimer, the term of this patent is extended or adjusted under 35 U.S.C. 154(b) by 495 days.

(21) Appl. No.: 17/062,297

(22) Filed: Oct. 2, 2020

(65) Prior Publication Data

US 2022/0106771 A1 Apr. 7, 2022

(51) Int. Cl.
*E02F 9/26* (2006.01)
*E02F 3/84* (2006.01)
*E02F 9/16* (2006.01)

(52) U.S. Cl.
CPC ..... *E02F 9/262* (2013.01); *E02F 3/847* (2013.01); *E02F 9/166* (2013.01)

(58) Field of Classification Search
CPC . E02F 9/262; E02F 9/166; E02F 9/261; E02F 3/847; E02F 3/7609
See application file for complete search history.

(56) References Cited

U.S. PATENT DOCUMENTS 6,470,606 B1 * 10/2002 Nagahiro ..... E02F 9/26 37/348
9,440,591 B2 9/2016 Hendron et al.
9,871,968 B2 * 1/2018 Husted ..... H04N 7/181
2004/0098146 A1 * 5/2004 Katae ..... B66F 9/24 340/429
2012/0236142 A1 * 9/2012 Enix ..... E02F 9/2045 348/148
2013/0255977 A1 * 10/2013 Braunstein ..... E02F 3/847 701/41
2019/0048559 A1 * 2/2019 Olsen ..... E02F 3/32
(Continued)

OTHER PUBLICATIONS

Motec, "Motec camera systems for agricultural machines," <https://www.motec-cameras.com/en/camera-systems-agriculture/> web page publicly available at least as early as Oct. 2, 2020.
(Continued)

*Primary Examiner* — Russell Frejd
(74) *Attorney, Agent, or Firm* — Michael Best & Friedrich LLP

(57) ABSTRACT

An work vehicle includes a chassis. A prime mover, an operator cab and a camera are supported by the chassis. The operator cab has a user interface. A first ground-engaging member and a second ground-engaging member positioned on opposite sides of the chassis are configured to move the work vehicle in a direction of travel when actuated by the prime mover. A work attachment is movably coupled to the chassis by a coupling mechanism. The camera is configured to capture an image of an area between the one of the first and second ground-engaging members and the work attachment and an area in front of the work attachment. A control system includes a controller in communication with the user interface and the camera. The controller is configured to display the image captured by the camera on the user interface.

19 Claims, 8 Drawing Sheets

(56) References Cited

U.S. PATENT DOCUMENTS

2020/0363203 A1* 11/2020 Plouzek ..... G01C 11/10

OTHER PUBLICATIONS

Dressta, "TD-16N—The New Benchmark for Visibility," <https://td-16n.dressta.com/> web page publicly available at least as early as Oct. 2, 2020.

Komatsu, "Small Dozers," <https://www.komatsuamerica.com/equipment/dozers/small#page=0&sortby=sortorder&sortdir=Asc> web page publicly available at least as early as Oct. 2, 2020.

Cat, "Minestar Command for Dozing," <https://www.cat.com/en_US/by-industry/mining/surface-mining/surface-technology/command/command-dozing.html> web page publicly available at least as early as Oct. 2, 2020.

Level Best, "PD Series Dual Mast," <https://www.levelbestgrading.com/products/pd-series-para-level-dual-mast> web page publicly available at least as early as Oct. 2, 2020.

* cited by examiner

WORK VEHICLE

FIELD

The present disclosure relates to a work vehicle including a forward-looking camera for assisting the operator in driving the work vehicle.

SUMMARY

In one embodiment a work vehicle includes a chassis, a prime mover supported by the chassis, and an operator cab supported by the chassis and including a user interface. A work attachment is movably coupled to the chassis. A first coupling mechanism and a second coupling mechanism are coupled between the work attachment and the chassis. Each of the first coupling mechanism and the second coupling mechanism include an actuator configured to selectively move the work attachment relative to the chassis. A first camera is supported by the first actuator and is configured to capture a first image forward of the work vehicle. A second camera is supported by the second actuator and configured to capture a second image forward of the work vehicle. A control system includes a controller in communication with the user interface and the camera. The controller is configured to display a combined image on the user interface including a portion of the first image and a portion of the second image.

In another embodiment a work vehicle includes a chassis, a prime mover supported by the chassis, and an operator cab supported by the chassis. The operator cab includes a user interface. A work attachment is coupled to the chassis by a coupling mechanism, which includes an actuator configured to move the work attachment relative to the chassis. A camera is supported by the actuator and is configured to capture an image. A control system includes a controller in communication with the user interface and the camera. The controller is configured to display the image captured by the camera on the user interface.

In another embodiment a work vehicle includes a chassis and a prime mover supported by the chassis. A first ground-engaging member is positioned on a first side of the chassis and a second ground-engaging member is positioned on a second side of the chassis that is opposite the first side. The first ground-engaging member and the second ground-engaging member are configured to move the work vehicle in a direction of travel when actuated by the prime mover. An operator cab supported by the chassis and including a user interface. A work attachment is movably coupled to the chassis by a coupling mechanism. A camera is supported by the chassis and is configured to capture an image of an area between the one of the first and second ground-engaging members and the work attachment and an area in front of the work attachment. A control system includes a controller in communication with the user interface and the camera. The controller is configured to display the image captured by the camera on the user interface.

Before any embodiments of the disclosure are explained in detail, it is to be understood that the disclosure is not limited in its application to the details of construction and the arrangement of components set forth in the following description or illustrated in the following drawings. The disclosure is capable of supporting other embodiments and of being practiced or of being carried out in various ways. Also, it is to be understood that the phraseology and terminology used herein is for the purpose of description and should not be regarded as limiting.

DETAILED DESCRIPTION

Figure 1:
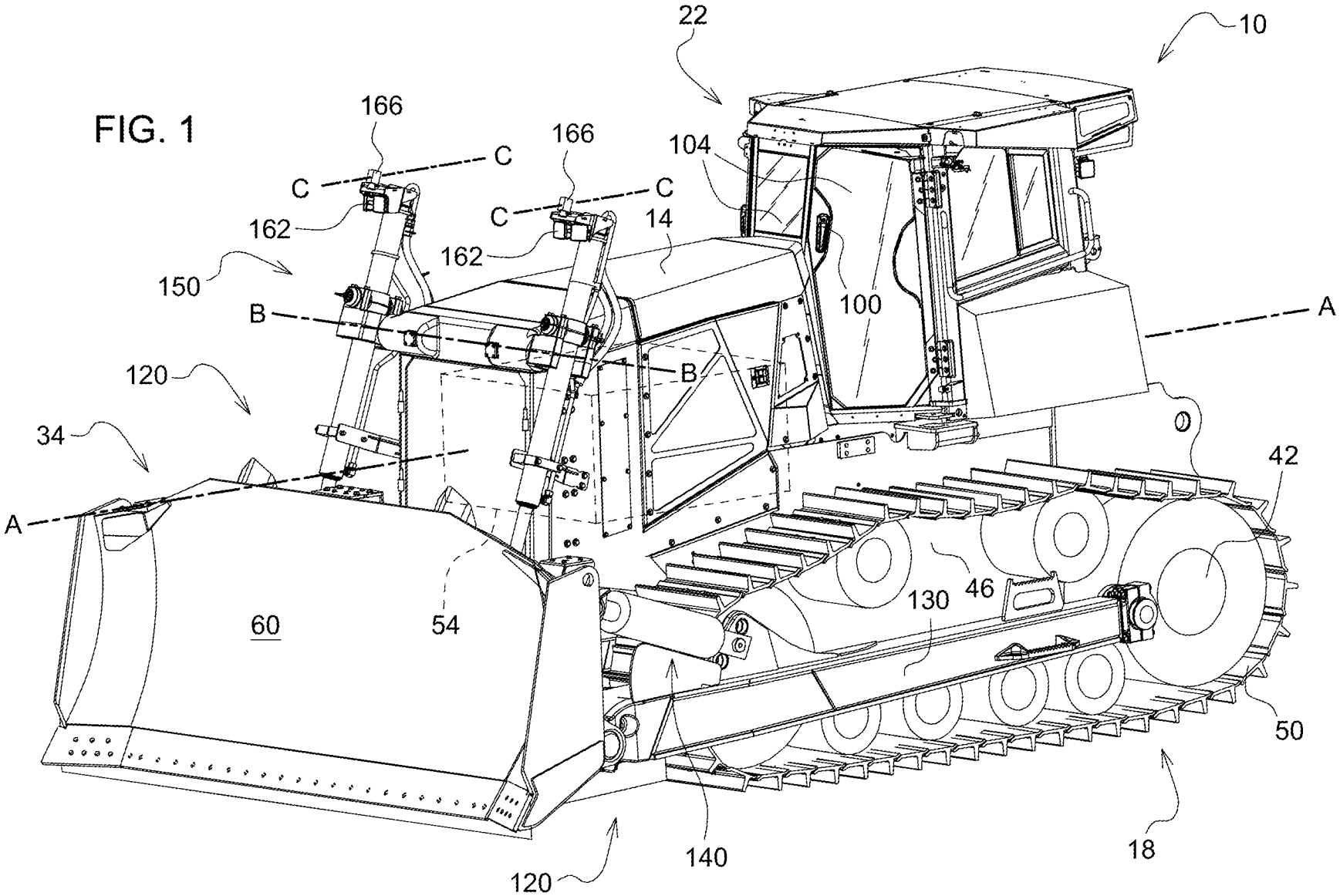
FIG. 1 shows a perspective view of a work vehicle including an operator cab, a first camera, and a second camera.
Figure 2:
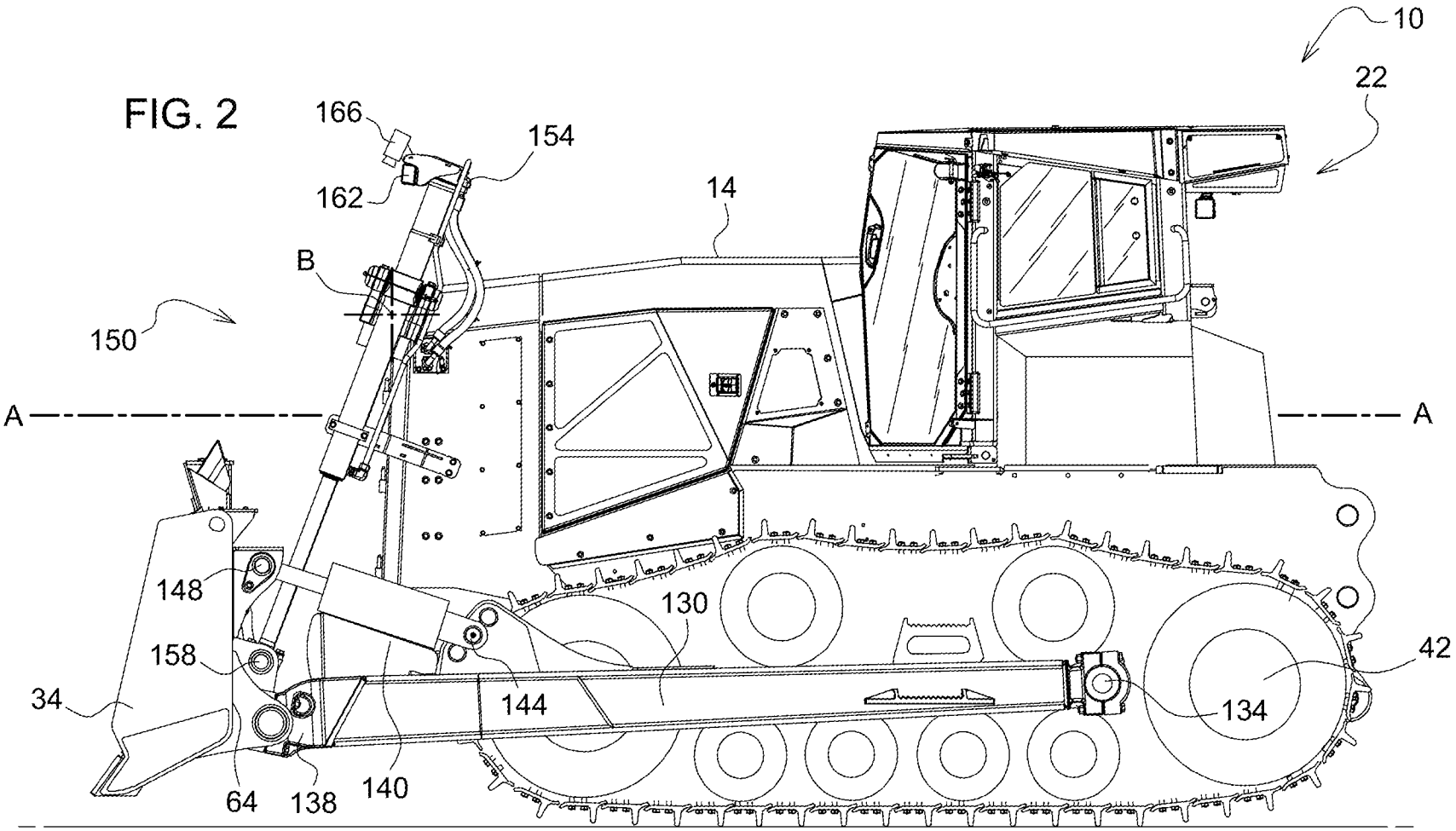
FIG. 2 shows a side view of the work vehicle of FIG. 1.
Figure 3:
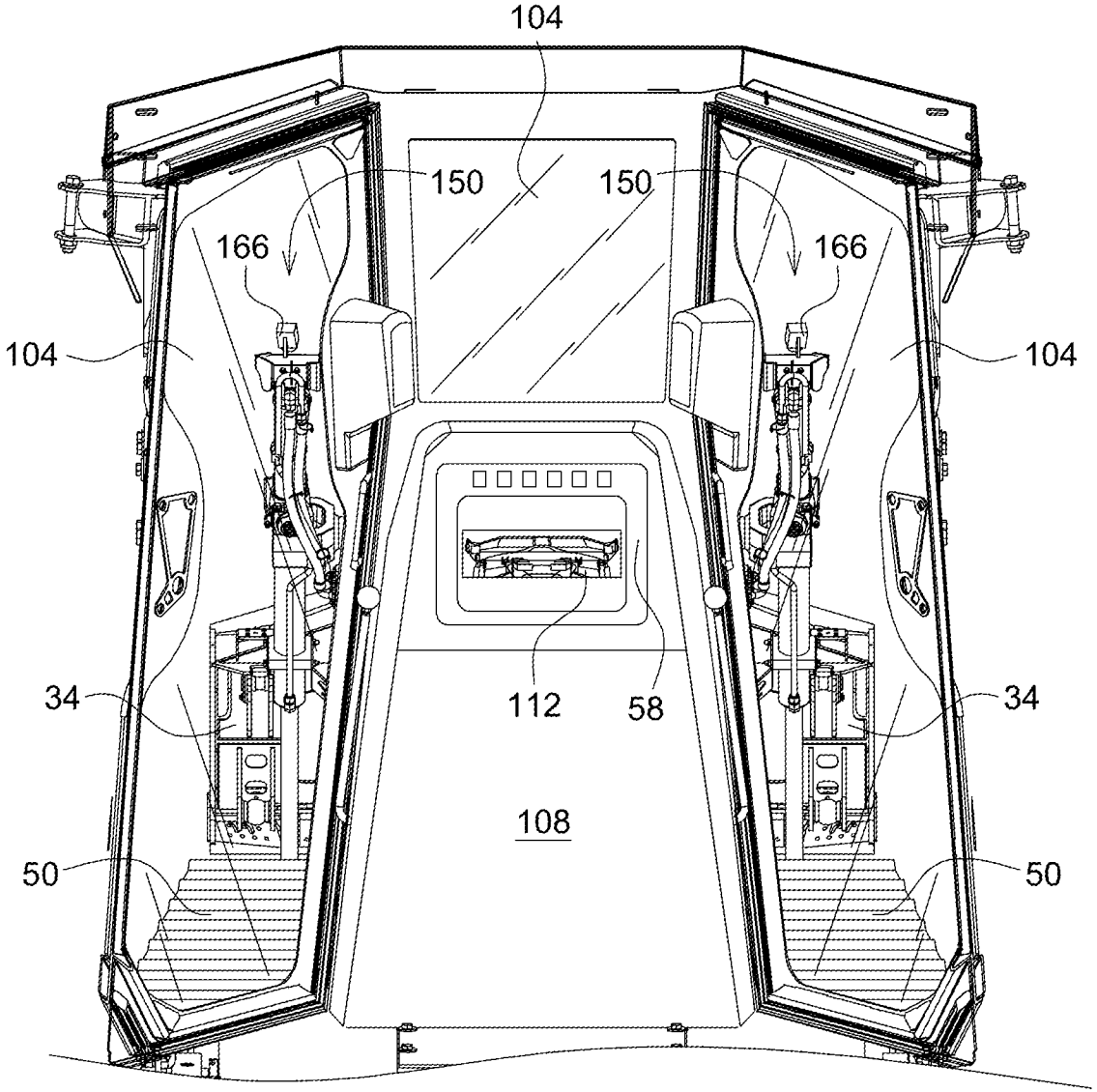
FIG. 3 shows an operator's view from the cab of FIG. 1.
Figure 4:
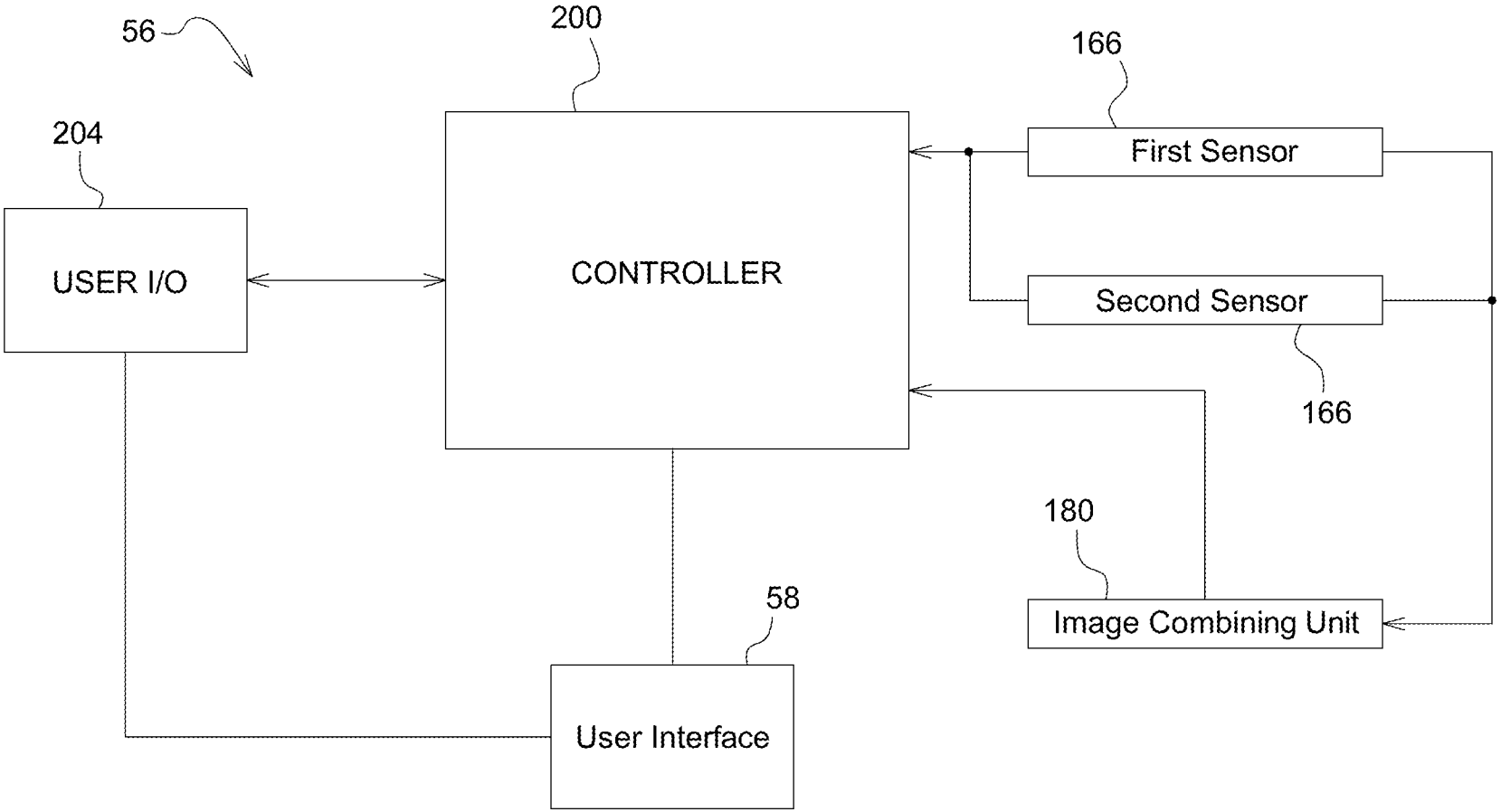
FIG. 4 shows a schematic of the control system of the work vehicle of FIG. 1

FIGS. 1 and 2 illustrate a work vehicle, such as a dozer 10, having a chassis 14 and a ground-engaging member (e.g., tracks or crawler mechanisms 18) for supporting and propelling the chassis 14 and therefore the vehicle 10 along a surface. In the illustrated embodiment, the chassis 14 supports a body of the work vehicle 10 having a hood 20 and at least partially defining an operator cab 22. A longitudinal axis A of the work vehicle defines a plane that bisects the work vehicle 10. A first side of the work vehicle 10 exists on a first side of the plane and a second side of the work vehicle 10 exists on a second side of the plane. The crawler mechanisms 18 are on opposite sides of the plane and are oriented parallel to the longitudinal axis A of the chassis 14, which coincides with a forward direction of travel of the vehicle 10 during operation. In the illustrated embodiment, each crawler mechanism 18 includes a drive sprocket 42, an undercarriage frame 46, and a track 50. The drive sprocket 42 is driven by a prime mover 54 (e.g., engine) and engages the track 50. The track 50 is driven in an endless loop around the drive sprocket 42 and the undercarriage frame 46. The illustrated vehicle 10 further includes a work attachment 34 movably coupled relative to a front of the chassis 14, a control system 56 (FIG. 4), and a user interface 58 (FIG. 3). In the illustrated embodiment, the work attachment 34 is a blade. The blade includes a working side 60 that defines a bucket and a non-working side 64 (FIG. 2) that is adjacent the chassis 14.

Although the work vehicle 10 is illustrated and described as a dozer, it is understood that the work vehicle 10 may have a different form, such as a loader, an excavator, a motor grader, a scraper, or another type of construction, mining, agricultural, or utility vehicle. Also, although the work attachment is illustrated and described as a blade, it is understood that the work attachment may have a different form, such as an auger, a breaker, a ripper, a grapple, or some other type of attachment for digging, breaking, handling, carrying, dumping or otherwise engaging dirt or other material.

As shown in FIG. 1-3, the operator cab 22 includes at least one door 100 and a plurality of windows 104. The operator cab 22 further includes a console 108 including the user interface 58 and a chair (not shown) that is configured to support the operator. The plurality of windows 104 includes a first window positioned above the console 108 and between second and third windows on opposite sides thereof. The at least one door 100 defines one of the plurality of windows 104. A vehicle operation system is positioned in the cab 22 and can include different combinations of input devices, one of which is the user interface 58. As shown, the user interface 58 includes a display screen 112 (FIG. 3). In some embodiments, the vehicle operation system includes other or additional input devices, such as a steering wheel, control levers, control pedals, and other suitable input devices.

Referring again to FIGS. 1 and 2, in the illustrated embodiment, the blade 34 is movably coupled relative to the chassis 14 by a first coupling mechanism 120 and a second coupling mechanism 120. The first coupling mechanism 120 is positioned on the first side of the work vehicle 10 and the second coupling mechanism 120 is positioned on the second side of work vehicle 10. The first coupling mechanism 120 and the second coupling mechanism 120 are the same. Therefore, while only the first coupling mechanism 120 is described herein, it should be understood that this description applies to the second mechanism 120 as well.

The first coupling mechanism 120 includes a linkage 130 that is movably coupled between the undercarriage frame 146 and the non-working side 64 of the blade 34. The linkage 130 has a first end 134 that is movably (e.g., pivotably) coupled to the undercarriage frame 46 and a second end 138 that is movably (e.g., pivotably) coupled to the non-working side 64 of the blade 34. The linkage 130 supports a tilt actuator 140. The tilt actuator 140 includes a first end 144 that is coupled to the linkage 130 and a second end 148 that is movably (e.g., pivotably) coupled to the non-working side 64 of the blade 34. A lift actuator 150 is coupled between the chassis 14 and the non-working side 64 of the blade 34. The lift actuator 150 includes a first end 154 that is spaced apart from (e.g., positioned above) the chassis 14 and a second end 158 that is movably (e.g., pivotably) coupled to the non-working side 64 of the blade 34. The second end 158 of the lift actuator 150 is spaced apart from the hood 20 by a distance of approximately 0.5 meters. The term approximately as used herein means plus or minus 0.1 meters. The lift actuator 150 is coupled to the chassis 14 at a location positioned between the first end 154 and the second end 158. In the illustrated embodiment, the lift actuator 150 is coupled to a front portion of the chassis 14 adjacent the hood 20. The lift actuator 150 is pivotable about an axis B that is transverse to the longitudinal axis A. Actuating the tilt actuators 140 allows the blade 34 to pivot relative to the linkage 130 and the chassis 14. Actuating the lift actuators 150 allows the blade to lift or move vertically relative to the chassis 14. The lift actuator 150 is pivotable about the axis B within a range of between five degrees and ten degrees to accommodate the full range of motion of the blade 34. Each of the tilt and lift actuators 140, 150 in the illustrated embodiment are hydraulic cylinders, but other configurations, such as pneumatic cylinders may be utilized.

Further with respect to FIGS. 1 and 2, the lift actuator 150 may support a light 162 and a sensor 166 that is in communication with the control system. As shown, in the illustrated embodiment, the light 162 and the sensor 166 are positioned at or adjacent to the first end 154 of the lift actuator 150. That is, the light 162 and the sensor 166 may be positioned within 1 meter of the first end 154 of the lift actuator. Accordingly, the sensor 166 is positioned at least approximately 0.5 meters above the hood 20. In the illustrated embodiment, the sensor 166 is a camera, although in some embodiments the sensor may be a scanner or other type of sensor. The camera 166 is in communication with the control system 56 and is configured to capture (e.g., view), in real time, an image of an area adjacent the work vehicle 10.

Figure 8:
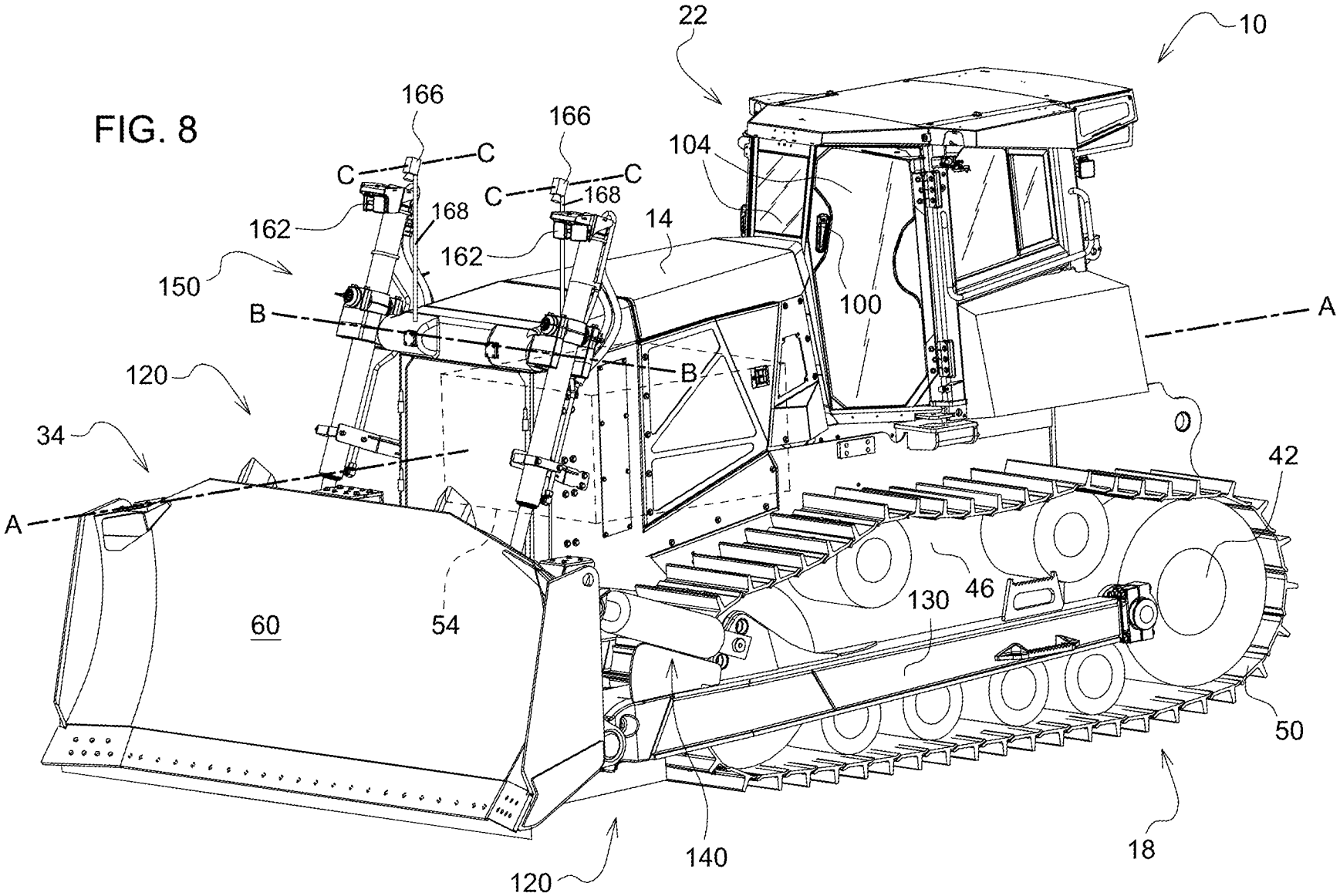
FIG. 8 shows a perspective view of a work vehicle according to another embodiment including an operator cab, a first camera, and a second camera.

In some embodiments, such as that of FIG. 8, one or more support members or extensions 168 may be secured to or otherwise extend from the hood 20 and may be positioned adjacent to a location where the lift actuator 150 is secured to the chassis 14. The one or more support members 168, rather than the lift actuators 150, may support either or both of the light 162 and the sensor 166 or additional lights 162 and additional sensors 166. Also, in the illustrated embodiments, there are two sensors—one supported by each of the lift actuators 150 or support member 168. In other preferred embodiments, there may be only one sensor supported on one or the other of the lift actuators 150 or support members 168. Additionally, while lights 162 and sensors 166 are only illustrated as being supported at the front of the work vehicle 10, one or more lights 162 and sensors 166 may be supported on existing or additional structure located on the top, rear, first side, or second side of the work vehicle 10 as well.

Figure 5:
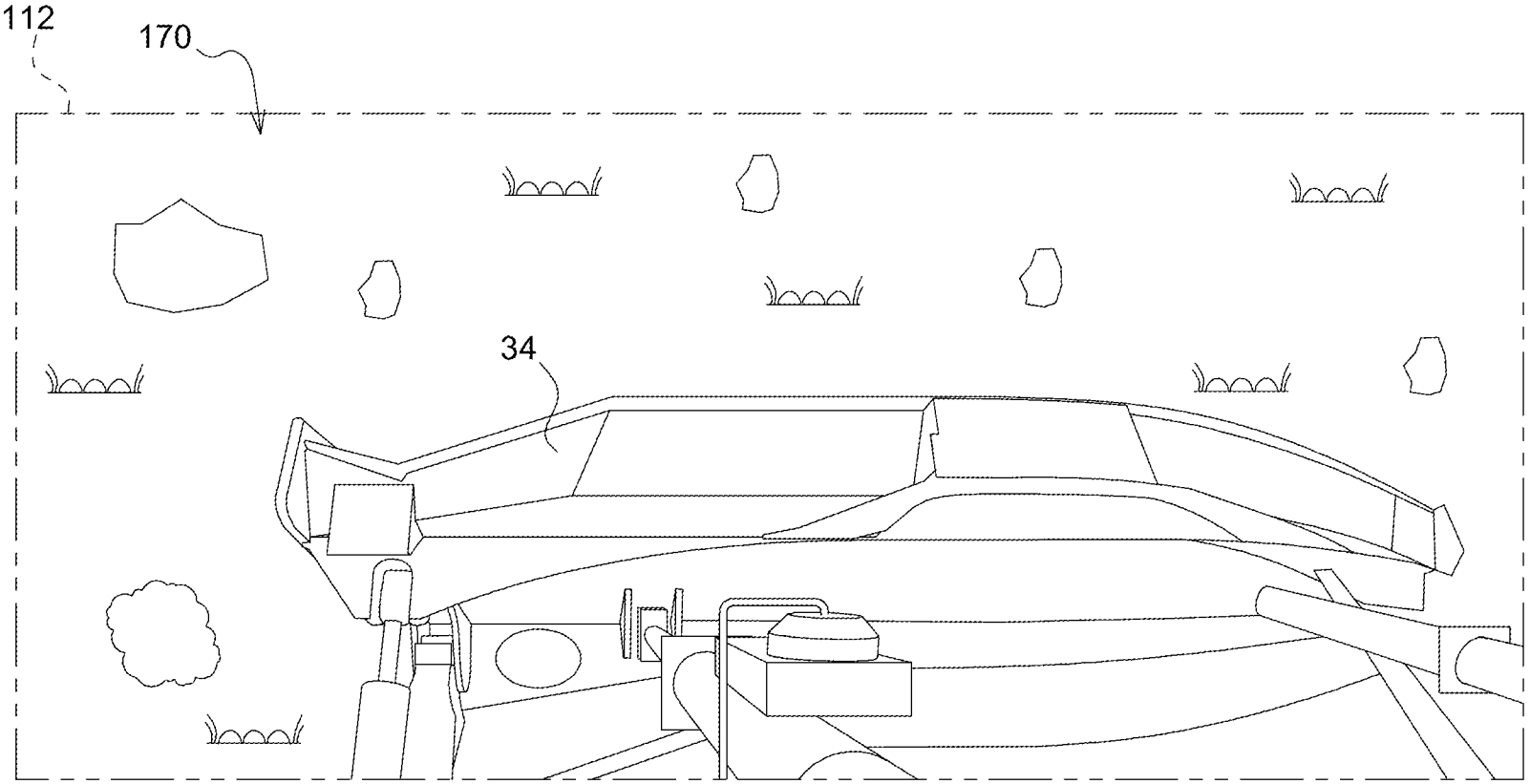
FIG. 5 shows a view from the first camera of FIG. 1.
Figure 6:
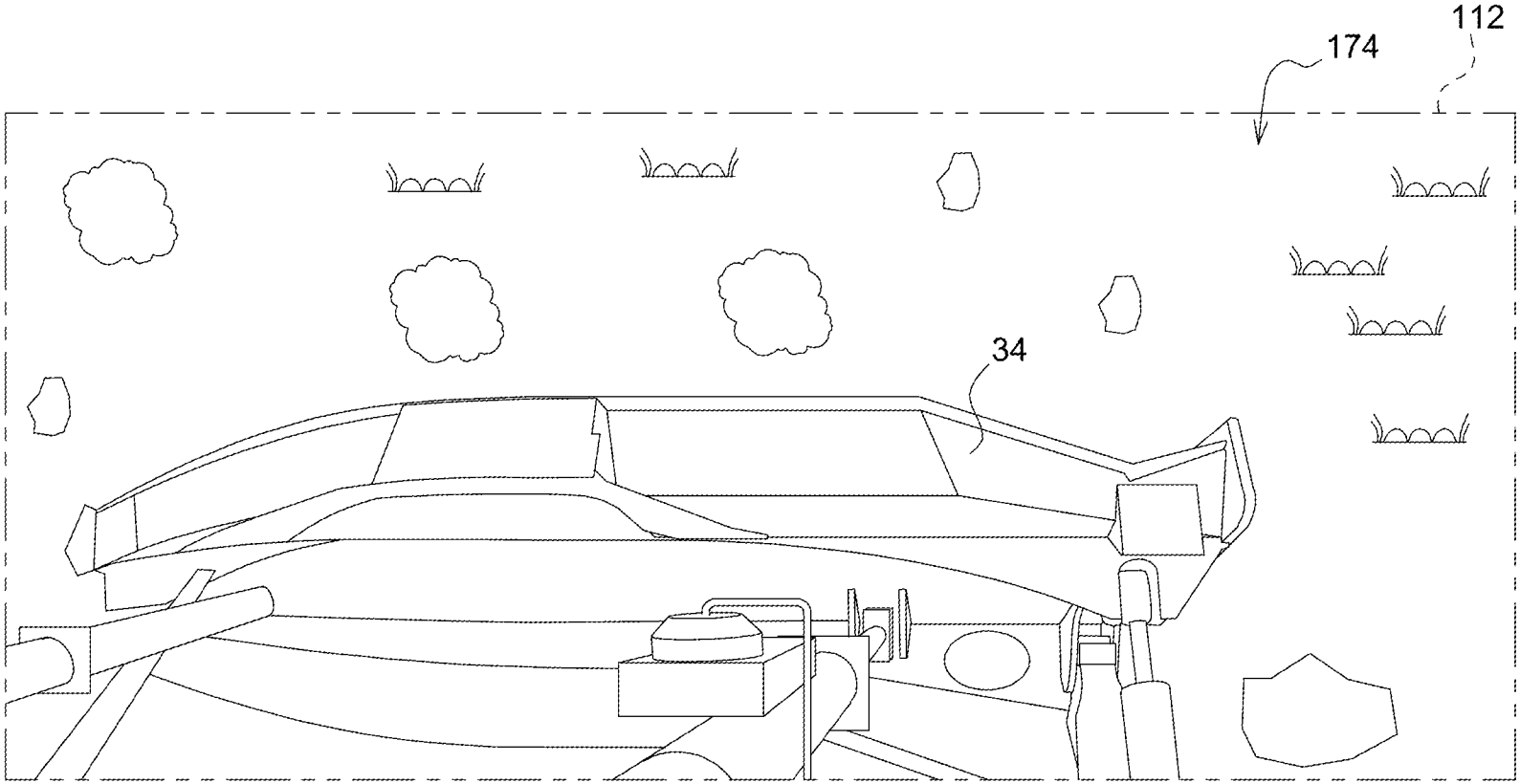
FIG. 6 shows a view from the second camera of FIG. 1.

The camera 166 on one of the lift actuators 150 (e.g., a first camera) is positioned on the first side of the work vehicle 10 and the camera 166 on the other of the lift actuators 150 (e.g., a second camera) is positioned on the second side of the work vehicle 10. Each of the first and second cameras 166 has a horizontal field of view that is greater than 45 degrees. In one preferred embodiment, each of the first and second cameras 166 has a horizontal field of view that is greater than 90 degrees. In another preferred embodiment, each of the first and second cameras 166 has a horizontal field of view that is 118 degrees. In another preferred embodiment, each of the first and second cameras 166 has a horizontal field of view that is 135 degrees. in the illustrated embodiment, the horizontal field of view of the first and second cameras 166 is the same, but other embodiments, the horizontal field of view of the first camera 166 may be different than the first camera 166. The first camera 166 is therefore configured to capture, in real time, a first image 170 (FIGS. 5 and 7) of an area in front of the work vehicle 10 that spans from a location or area on the first side of the work vehicle 10 to a location or area between the first camera 166 and the second camera 166. Similarly, the second camera 166 is therefore configured to capture, in real time, a second image 174 (FIGS. 6 and 7) of an area in front of the work vehicle 10 that spans from a location or area on the second side of the work vehicle 10 to a location between the first camera 166 and the second camera 166. In a preferred embodiment, the location between the first and second cameras 166 is at or beyond the plane of the longitudinal axis A. For example, the first camera 166 may be configured to capture an area from a longitudinal axis of the vehicle laterally to the first side of the vehicle 10, and the second camera 166 may be configured to capture an area from a longitudinal axis of the vehicle laterally to the second side of the vehicle 10. Regardless of the exact location between the first and second cameras 166, however, the horizontal field of view of the first camera 166 may be used with the horizontal field of view of the second camera 166 to create one view that captures the front of the work vehicle spanning from the first side to the second side thereof, which will be discussed in greater detail below. In some embodiments the horizontal field of view of the first camera 166 may be line to line with horizontal field of view of the second camera 166 to create one view that captures the front of the work vehicle spanning from the first side to the second side thereof. That is, in some embodiments, one side of the horizontal field of view of the first camera 166 may be aligned with one side of the horizontal field of view of the second camera 166. In some embodiments, the horizontal field of view of the first camera 166 may overlap with the horizontal field of view of the second camera 166 to create one view that captures the front of the work vehicle spanning from the first side to the second side thereof.

Additionally, each of the first and second cameras 166 is positioned such that it can capture, in real time, an area between one of the crawler mechanisms 18 and the blade 34. That is, the area captured by first camera 166 includes the area between the crawler mechanism 18 on the first side and the blade, and the area captured by the second camera 166 includes the area between the crawler mechanism 18 on the second side and the blade 34.

In the illustrated embodiments, each of the first and second cameras 166 is mounted to the respective lift actuator 150 along an axis C that it is parallel to the longitudinal axis A. Accordingly, the first and second cameras are oriented parallel to one another as well. In other embodiments, each of the first and second cameras 166 may be mounted to the respective lift actuator 150 such that the axis C is angled toward the longitudinal axis A. Accordingly, the first and second cameras may be oriented towards one another in other embodiments.

Figure 7:
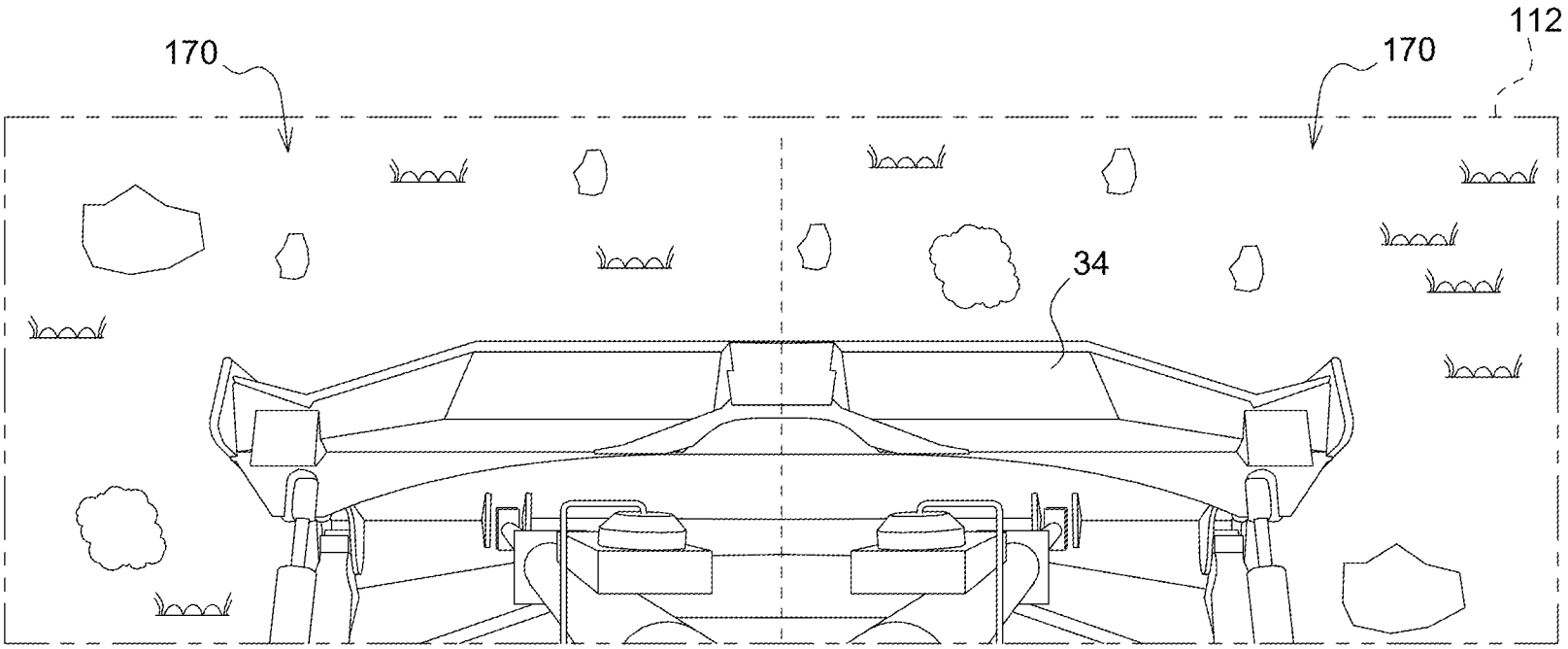
FIG. 7 shows a combined view of the first camera and the second camera of FIG. 1.

In some embodiments, an image combining unit 180, described in greater detail herein, is in communication with the control system 56 and is configured to stitch (e.g., merge or combine) a portion of the first image 170 captured by first camera 166 and a portion of the second image 174 captured by the second camera 166 into a single combined image (FIG. 7).

The control system 56 includes a controller 200 with a plurality of inputs and outputs that are operable to receive and transmit information and commands to and from different components, such as the user interface 58, cameras 166, and the image combining unit 180. Communication between the controller 200 and the different components can be accomplished through a CAN (e.g., an ISO bus), another communication link (e.g., wireless transceivers), or through a direct connection. The control system 56 further may include a user input/output module 64 that includes the one or more operator input devices, which are in communication with the controller 200. The input/output module 204 may be incorporated in or in communication with the user interface 58. The controller 200 may also include memory for storing software, logic, and algorithms. The controller 200 also includes a processor for carrying out or executing the software, logic, algorithms, programs, set of instructions, etc. stored in the memory.

In some embodiments, the controller 200 may be configured to receive information from the first camera 166 and the second camera 166, and send respective first and second image signals to the user interface 58 to display the first and second images 170, 174. Together, the first image 170 and the second image 174 preferably provides a horizontal field of view that is 180 degrees. In some embodiments, the image combining unit 180 may be configured to receive information from the first camera 166 and the second camera 166 and combine the information from the first camera 166 and the second camera 166 to form a single combined image, which is sent to the controller 200. The controller 200 may be configured to send a combined image signal to the user interface 58 to display the combined image. The single combined image preferably provides a horizontal field of view that is 180 degrees.

The operator is typically seated in the chair 30 during use and positioned to actuate one or more input devices of the vehicle operation system for purposes of operating movement of the work vehicle 10 and the blade. FIG. 3 illustrates a view that is similar to what the operator sees during operation. Notably, the operator cab 22, a front portion of the chassis 14 (e.g., the hood 20), and the blade 34 may create obstructions that make it difficult for the operator to see the area in front of the work vehicle 10. The cameras 166 are specifically positioned such that the operator can better visualize the area surrounding (and particularly in front of) the work vehicle 10. That is, the cameras 166 enable the operator to see, in real time, the top of the blade 34, as well as behind the blade 34 and in front of the blade 34. Accordingly, the operator is able to the see the topography (e.g., waves dips, divots, etc.) of the land around the blade 34, which may assist in more effective material planning, among other things. Moreover, the cameras 166 provide a bilateral view of the area in front of the vehicle 10. That is, the use of two cameras 166—one on each side of the vehicle 10—allows the operator to see in front of the vehicle 10 on both the first side and the second side. Additionally, these views are visible by the respective cameras 166 and do not significantly affect the images, regardless of the fact that the second actuators 150 tilt relative to the chassis 14 (and specifically the hood 20), as noted herein. The cameras 166 are also specifically spaced above the hood 20 by a predetermined distance (e.g., 0.5 meters) such that the blade, regardless of its position, never obstructs the view of the cameras 166. The resulting first image 170 taken by the first camera 166, second image 174 taken by the second camera 166, and single combined image created from the first and second images 170, 174 enable the operator to visualize the area in front of and in the periphery of the work vehicle 10 and therefore more effectively drive the work vehicle 10. For example, the single combined image defines a horizontal field of view that includes an area forward of the vehicle 10, an area from the longitudinal axis A of the vehicle laterally to the first side of the vehicle 10 (captured by the first camera 166), and an area from the longitudinal axis A laterally to the second side of the vehicle 10 (captured by the second camera 166). In the illustrated embodiment, the cameras 166 allow the operator to see 1 meter to 2 meters in front of the blade 34, although other ranges are possible.

Lack of visibility is a common concern for operators of large work vehicles. The use and position of the cameras 166 assists the operator in visualizing the area surrounding the vehicle 10.

Although the present subject matter has been described in detail with reference to certain embodiments, variations and modifications exist within the scope of one or more independent claims of the present subject matter, as described.

What is claimed is:

1. A work vehicle comprising:

a chassis;

a prime mover supported by the chassis;

an operator cab supported by the chassis and including a user interface;

a work attachment movably coupled to the chassis;

a first coupling mechanism and a second coupling mechanism coupled between the work attachment and the chassis, each of the first coupling mechanism and the second coupling mechanism including an actuator configured to selectively move the work attachment relative to the chassis;

a first camera supported by the first actuator, the first camera configured to capture a first image forward of the work vehicle;

a second camera supported by the second actuator, the second camera configured to capture a second image forward of the work vehicle; and a control system including a controller in communication with the user interface, the first camera, and the second camera, the controller configured to display a combined image on the user interface including a portion of the first image and a portion of the second image.

2. The work vehicle of claim 1, wherein the work attachment is coupled to a front end of the chassis and each of the first and second cameras are configured to capture an area forward and rearward of the work attachment.

3. The work vehicle of claim 1, further comprising a first ground-engaging member on a first side of the chassis and a second ground-engaging member on a second side of the chassis that is opposite the first side, the first ground-engaging member and the second ground-engaging member being configured to move the work vehicle in a direction of travel when actuated by the prime mover, wherein each of the first and second cameras are configured to capture an area forward of the work attachment, and wherein the first camera is positioned to capture an area between the first ground-engaging member and the work attachment and the second camera is positioned to capture an area between the second ground-engaging member and the work attachment.

4. The work vehicle of claim 1, wherein the actuator of each of the first coupling mechanism and the second coupling mechanism is a hydraulic cylinder, the actuators collectively configured to selectively raise and lower the work attachment relative to the chassis.

5. The work vehicle of claim 1, wherein the first image captured by the first camera includes at least a portion of an area on a first side of a longitudinal axis of the vehicle and the second image captured by the second camera includes at least a portion of an area on a second side of the longitudinal axis of the vehicle.

6. The work vehicle of claim 1, wherein a horizontal field of view of the first camera extends laterally from a longitudinal axis of the vehicle to a first side and a horizontal view of the second camera extends laterally from the longitudinal axis of the vehicle to a second side.

7. The work vehicle of claim 1, wherein each of the first actuator and the second actuator includes a first end movably coupled to the work attachment and a second end spaced apart from the first end, the first camera being positioned adjacent the second end of the first actuator and the second camera being positioned adjacent the second end of the second actuator.

8. The work vehicle of claim 1, further comprising an image combining unit in communication with the first camera, the second camera, and the control system, the image combining unit configured to receive information from the first camera and the second camera and combine the information from the first camera and the second camera to form the combined image.

9. The work vehicle of claim 1, wherein the combined image defines a horizontal field of view that includes an area forward of the vehicle, an area from a longitudinal axis of the vehicle laterally to a first side of the vehicle, and an area from the longitudinal axis laterally to a second side of the vehicle.

10. A work vehicle comprising:

a chassis;

a prime mover supported by the chassis;

an operator cab supported by the chassis and including a user interface;

a work attachment coupled to a front end of the chassis by a coupling mechanism, the coupling mechanism including an actuator configured to move the work attachment relative to the chassis;

a camera supported by the actuator, the camera configured to capture an image including an area that is forward of the vehicle and forward and rearward of the work attachment; and a control system including a controller in communication with the user interface and the camera, the controller configured to display the image captured by the camera on the user interface.

11. The work vehicle of claim 10, wherein the actuator is a hydraulic cylinder that selectively raises and lowers the work attachment relative to the chassis.

12. The work vehicle of claim 10, wherein the camera is spaced apart from a hood of the chassis by a distance of at least 0.5 meters.

13. The work vehicle of claim 10, wherein a field of view of the camera is at least 80 degrees.

14. The work vehicle of claim 10, further comprising ground-engaging members that are configured to move the work vehicle in a direction of travel when actuated by the prime mover, and wherein the camera is positioned to capture an area between one of the ground-engaging member and the work attachment and an area in front of the work attachment.

15. The work vehicle of claim 10, wherein the actuator includes a first end movably coupled to the work attachment and a second end spaced apart from the first end, the camera being positioned adjacent the second end of the actuator.

16. A work vehicle comprising:

a chassis;

a prime mover supported by the chassis;

a first ground-engaging member on a first side of the chassis and a second ground-engaging member on a second side of the chassis that is opposite the first side, the first ground-engaging member and the second ground-engaging member being configured to move the work vehicle in a direction of travel when actuated by the prime mover;

an operator cab supported by the chassis and including a user interface;

a work attachment movably coupled to the chassis by a coupling mechanism; and a first camera supported by the chassis and configured to capture a first image of an area between the one of the first and second ground-engaging members and the work attachment and an area in front of the work attachment;

a second camera supported by the chassis and configured to capture a second image of an area between the other of the first and second ground-engaging members and the work attachment and an area in front of the work attachment, and a control system including a controller in communication with the user interface and the first camera and the second camera, the controller configured to display a combined image on the user interface including a portion of the first image and a portion of the second image.

17. The work vehicle of claim 16, further comprising an image combining unit in communication with the first camera, the second camera, and the control system, the image combining unit configured to receive information from the first camera and the second camera and combine the information from the first camera and the second camera to form the combined image.

18. The work vehicle of claim 16, wherein a field of view of the camera is at least 80 degrees.

19. The work vehicle of claim 16, wherein the camera is spaced apart from a hood of the chassis by a distance at least 0.5 degrees.

* * * * *